United States Patent [19]

Daniell, Jr.

[11] 4,377,872

[45] Mar. 29, 1983

[54] SELF-INTERLOCKING PLASTIC STRAP

[76] Inventor: Roy B. Daniell, Jr., 4221 N. Shallowford Rd., Apt. 4, Chamblee, Ga. 30341

[21] Appl. No.: 171,497

[22] Filed: Jul. 23, 1980

[51] Int. Cl.[3] ..... A41F 9/02

[52] U.S. Cl. ..... 2/321; 2/338; 24/16 PB

[58] Field of Search ..... 2/321, 322, 311, 309, 2/312, 314, 316, 338, 339, 340; 63/5 R; 24/16 PB

[56] References Cited

U.S. PATENT DOCUMENTS

| | | | |
|---|---|---|---|
| 1,725,998 | 8/1929 | Rockwood | 2/338 X |
| 2,004,098 | 6/1935 | Andrews | 2/321 X |
| 2,430,957 | 11/1947 | Seitz | 2/321 |
| 2,445,889 | 7/1948 | Rossi et al. | 2/338 |
| 3,063,058 | 11/1^62 | Vollet | 2/338 |
| 3,203,200 | 8/1965 | Inotsume | 2/339 X |

FOREIGN PATENT DOCUMENTS

| | | | |
|---|---|---|---|
| 1953407 | 5/1971 | Fed. Rep. of Germany | 2/339 |
| 311964 | 10/1933 | Italy | 2/339 |

*Primary Examiner*—H. Hampton Hunter

*Attorney, Agent, or Firm*—Vivian L. Leon; Harry I. Leon

[57] ABSTRACT

A non-constrictive, resilient strap having flattened elongated links, each pair of links being rigidly joined together by a neck of solid material through which the centerline of the strap passes. The longitudinal axis of each link is disposed perpendicular to the centerline. The strap is formed of a plastic in a single injection molding operation. The chemical composition of the strap determines the rate at which it flexs in response to an applied force. For use in protective devices for athletes such as knee braces, the straps are formed of polyethylene or of polypropylene in order to provide adequate support and at the same time allow freedom of muscle movement.

The strap is self-interlocking. Alternately, the strap may be fastened to a buckle formed of plastic having a keeper which engages a pair of slots disposed on either side of one of the necks of the strap.

10 Claims, 13 Drawing Figures

Fig. 1
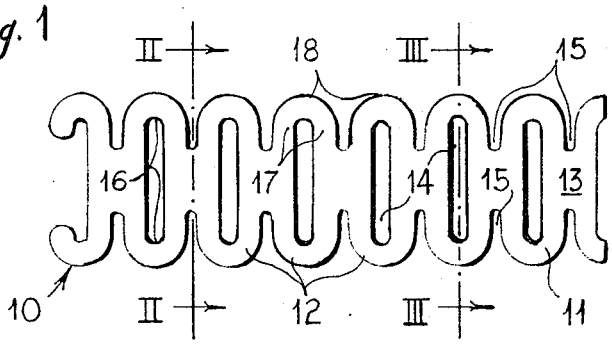
Fig. 2
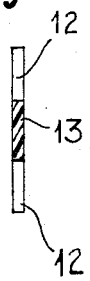
Fig. 3
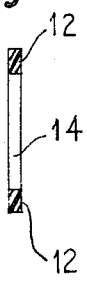
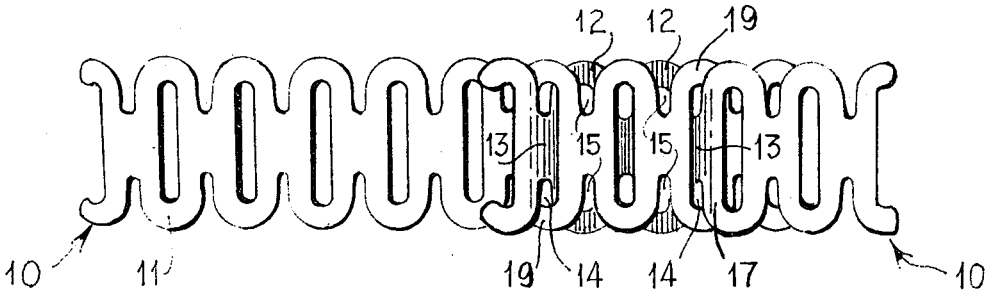
Fig. 4
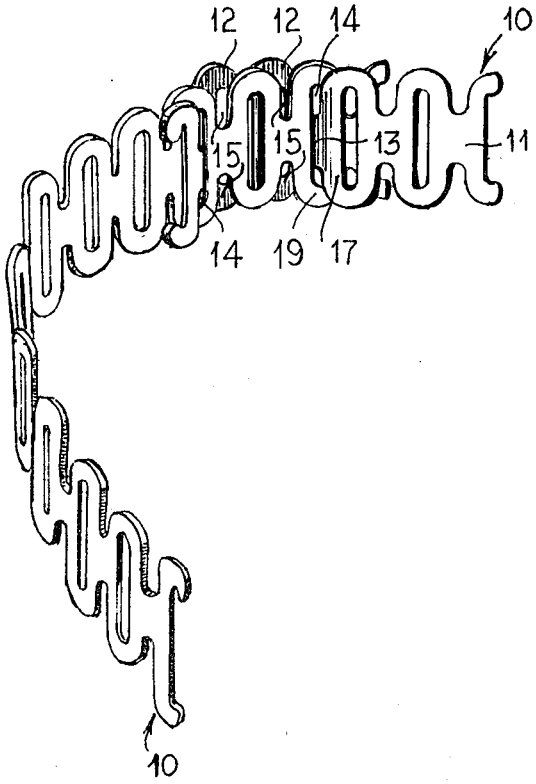
Fig. 5

Fig. 6
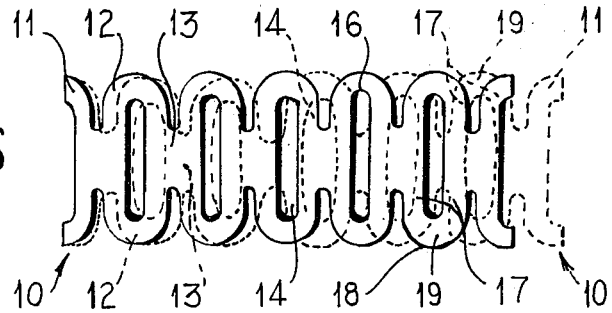
Fig. 13
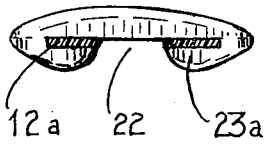
Fig. 7
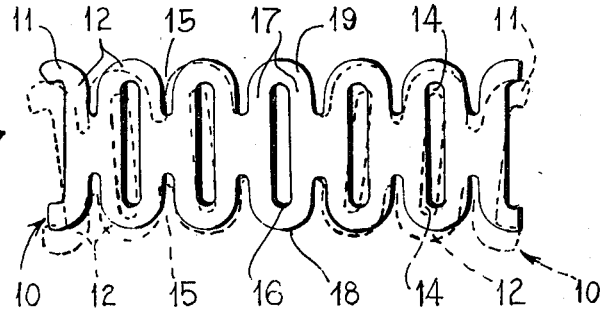
Fig. 8
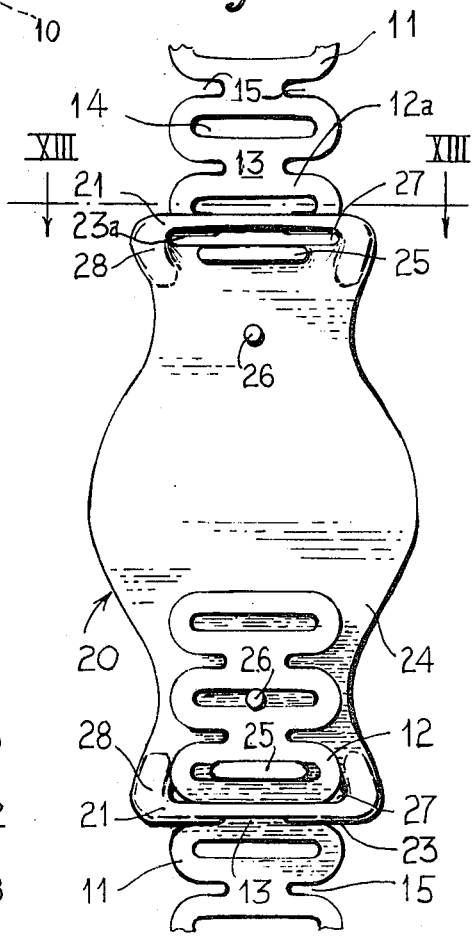
Fig. 9
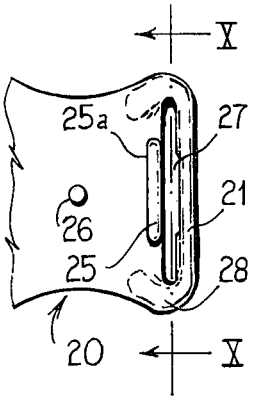
Fig. 10
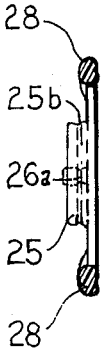
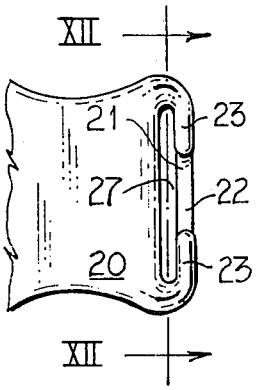
Fig. 11
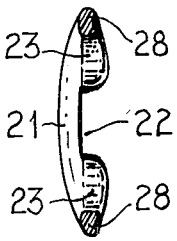
Fig. 12

SELF-INTERLOCKING PLASTIC STRAP

BACKGROUND OF THE INVENTION

1. Field of the Invention

This invention relates generally to resilient plastic straps and buckles and more particularly to such straps and buckles which are formed as a single, unitary piece in which the strap is also self-interlocking.

2. Description of the Prior Art

Means for imparting mechanical stength and flexibility to a plastic strap or belt has already been described in U.S. Pat. No. 2,445,889. According to the patent cited, straps formed of thermoplastic material follow only slowly and gradually an applied force or the removal of such a force and have limited mechanical strength. To provide a resiliency or spring action in the longitudinal direction in such straps as well as to reinforce them, a thin strip of spring metal is completely embedded in each strap. The spring metal is sandwiched between two strips of thermoplastic which is consolidated into a single strap by heat treatment or by cementing. In the event the spring metal becomes exposed, it can seriously injure the wearer; the hazard is particularly great when the wearer is exposed to severe impact forces. Hence such straps are not suitable for use in protective devices for athletes engaged in contact sports.

Further, the straight outer side edges of the straps in the patent cited, while useful in preventing the tearing of the strap and exposure of the metal strip, conform poorly to the contour of an object about which the strap is placed. In applications in which the strap is stretched across the muscle of a wearer's limb, such a strap tends to chafe the wearer's skin or to cut into protective foam padding placed beneath the strap.

Moreover, the transversely-extending, elongated apertures in the patent cited occupy only a minimal portion of the surface area of each strap, the apertures being limited to the central portions of each strap in which the metal strip is not embedded. The amount of ventilation to reduce perspiration caused by the strap is also minimal, further adding to the discomfort experienced by wearers of such a strap.

SUMMARY OF THE INVENTION

In the improved plastic strap according to the present invention, the use of a metal insert has been eliminated. Rather the improved strap is a single, unitary piece formed of plastic.

The improved strap comprises a flattened strip of plastic having a plurality of elongate, transversely extending apertures formed therein. The apertures are disposed along the strip at intervals which are uniformly spaced-apart. Between each contiguous pair of apertures, a pair of slots is formed; each slot extends inwardly from one of the side edges of the strip and terminates between the apertures. The design and arrangement of the apertures and slots provide flexibility and allow a user to intertwine a portion of the improved strap with another portion thereof to close the strap upon itself. This self-interlocking is accomplished by passing an end section of the strap through a pair of apertures formed in the strap and separated from each other by a portion thereof having at least one pair of slots. Furthermore, the strap is formed by a single injection operation and has substantially greater mechanical strength than if were formed from a single sheet of plastic. Thus in accordance with this invention there is provided a strong, flexible, self-interlocking plastic strap.

Moreover, those portions of the improved strap which are disposed between the outer side edges thereof and the ends of the apertures form a series of arches, thereby enhancing the spring action of the strap. The design and arrangement of the arches allow the strap to be stretched, bent, and twisted in substantially greater amounts than would otherwise be possible, without permanent deformation, for a strap without openings having the same cross-sectional area of solid material.

When the strap according to the present invention is formed of polyethylene or of polypropylene in contrast to its being formed of rubber or of a similar material, the strap deforms less per unit load under the impact of a sudden force, allowing the impact to be dissipated over a larger area, but is sufficiently flexible to follow gradual fluctuations in the contour of the object across which the strap is extended. Thus the present invention provides a non-constrictive, resilient strap which, when used to secure a protective device about an athlete's leg both dissipates the force of an impact received by the device or strap and responds sufficiently quickly to the rolling and swelling of the athlete's leg muscles during running that the wearer does not experience a feeling of constant binding.

A further object of one embodiment of the present invention is to provide a strap for use in trouser waistbands, girdles, and similar articles in which a slow release of the strap with the expansion of the object across which it is stretched is required.

The capacity of the improved strap to conform to the contour of an object across which the strap is stretched is also enhanced by the curved outer side edges of the arches as above described, adding to the feeling of comfort experienced by wearers of the improved strap.

The surface of the solid material of the strap according to the present invention occupies an area which is only approximately one-half of the area encompassed by a strap with straight side edges having the same overall width. The reduced distances between openings in the improved strap allows increased ventilation of a wearer's skin, further adding to the feeling of comfort experienced by wearers of this strap.

There is also disclosed a strap which includes a buckle having a keeper which is engageable with a pair of slots formed in the strap. The buckle and the flattened strip as above described comprise a single, unitary piece formed of plastic in this alternate embodiment of the present invention.

Other objects and advantages will appear from the following description of an example of the invention, when considered in connection with the accompanying drawings, and the novel features will be particularly pointed out in the appended claims.

BRIEF DESCRIPTION OF THE DRAWINGS

FIG. 1 is an elevation view of a fragmentary section of a strap embodying the present invention;

FIG. 2 is a cross-section II—II with respect to FIG. 1, showing a transverse section of the strap;

FIG. 3 is a cross-section III—III with respect to FIG. 1, showing a transverse section of the strap;

FIG. 4 is an elevation view of two straps according to FIG. 1 with the straps joined together in interlocking position;

FIG. 5 is a perspective view on a reduced scale of the two straps interlocked as shown in FIG. 4, in which the interlocked straps are bent as though they were extended across the curved surface of a cylindrical object;

FIG. 6 is an elevation view of the strap according to FIG. 1 shown, with the solid lines, in an unstrained, no-load condition and, with the dashed lines, in an expanded condition, the strap being stretched longitudinally;

FIG. 7 is an elevation view of the strap according to FIG. 1 shown, with the solid lines, in an unstrained, no-load condition and, with the dashed lines, generally deflected along an arc, the transverse sections of the strap being bisected lengthwise by the plane in which the arc lies;

FIG. 8 is a frontal elevation view of a strap with a buckle to which a section of strap according to FIG. 1 is fastened;

FIG. 9 is a frontal elevation view of a fragmentary section of the buckle shown in FIG. 8;

FIG. 10 is a cross-section X—X with respect to FIG. 9;

FIG. 11 is a rear elevation view of a fragmentary section of the buckle shown in FIG. 8;

FIG. 12 is a cross-section XII—XII with respect to FIG. 11; and

FIG. 13 is a cross-section XIII—XIII with respect to FIG. 8.

Like reference characters indicate corresponding parts throughout the several views of the drawings.

DESCRIPTION OF THE PREFERRED EMBODIMENT

As illustrated in FIG. 1 of the drawings, a strap 10, embodying the present invention, comprises a flattened strip 11 of links 12, each link having an elongated, transversely extending aperture 14 formed therein. The links 12 are uniformly spaced-apart longitudinally along the strip 11, each pair of contiguous links being connected to a neck 13. The links 12 and the necks 13 form a regular pattern, the distance separating repetitive elements of this pattern being approximately one-half the width of each link 12 measured in a direction perpendicular to the centerline of the strap between the outer side edges 18. This elongation of the links 12 imparts flexibility to the strap when it is stretched longitudinally as described below.

Two pairs of slots 15 are disposed generally parallel to each aperture 14 (see FIG. 1). As illustrated in FIGS. 1–3, the aperture 14 is somewhat greater in length than the combined width, measured in a direction perpendicular to the centerline of the strap 10, of each neck 13 and slot 15. On the other hand, the width of the aperture 14, measured in a direction parallel to the centerline, is approximately twice the thickness of the strap 10, the thickness of the strap 10 being generally uniform throughout its length. By way of example, the length of the aperture 14, shown in cross-section in FIG. 3, is approximately 13/16th inch whereas the combined width of the neck 13, shown in cross-section in FIG. 2, and of each of the slots 15 is approximately ¾ th inch, the thickness of a typical link 12 being approximately 60 mil. Thus one or more of the links 12 can be passed through the aperture 14 of a link 12 provided the latter link is sufficiently distant from the links to be passed through it in a case in which links on the same strip are being intertwined. Self-interlocking is readily accomplished by passing an end section of the strap 10 through a pair of apertures 14 which are separated from each other by a portion of the strap having at least two pairs of slots formed therein as shown in FIGS. 4 and 5; the strap 10 may also be self-interlocked when this pair of apertures 14 are separated from each other by a portion of the strap having only one pair of slots 15 formed therein. The self-interlocking is complete when the legs 17 on one side of at least two pairs of slots 15 engage the arches 19 contiguous to a pair apertures 14 when the portions of the strip 11 which are proximate to the interlocked segments thereof are stretched longitudinally in opposite directions. The segments of the strip 11 which are interlocked have substantially greater strength than the remainder of the strip 11. In addition to forming its own means of closure, the self-interlocking strip can be repaired, extended in length, or intertwined with a similar strip to form a strap of increased strength.

As illustrated in FIG. 6, the strap 10 may be stretched longitudinally a sufficient distance to cause the width of the apertures 14 to nearly double in size along the centerline of the strap. The dashed lines in FIG. 6 show the strap 10 when it is in an extended condition with the strap being stretched longitudinally. When so stretched, the opposing legs 17 of each link 12 of the strap 10 flex apart, the widest separation between the legs occurring between those portions thereof to which the necks 13 are joined. The least separation occurs near the arches 19. Each arch 19 resists the displacement of the legs 17 joined to it and promptly returns them to their unstretched condition once the applied force has been removed, provided the strap has not been stretched to the point of elastic fatigue. The arches thus concentrate stress near the outer side edges 18 of the strap 10 allowing a greater deformation to occur per unit of applied load than would occur in a strap of less width having the same amount of solid material disposed perpendicularly to the load. Because the radius of curvature of the arches 19 is sufficiently large, the strap 10 is not permanently deformed under the impact of forces normally encountered by wearers of such a strap. Thus the series of arches 19 formed between the outer side edges 18 and the ends 16 of the apertures 14 enhance the spring action of the strap 10.

The amount by which the ends of a section of the strap 10 may be displaced transversely with respect to the centerline of the unflexed strap 10 is illustrated in FIG. 7. The solid lines show the unflexed strap; the dashed lines show the strap transmitting a bending moment, being deflected along an arc, the transverse sections of the strap being generally bisected lengthwise by the plane in which the arc lies. During such a deflection, the arches 19 on one side of the centerline of the strap 10 flex toward each other, partially filling the slots 15, while the portions of the necks 13 which are proximate to the narrowed slots increase in thickness; simultaneously, the arches 19 on the other side flex away from each other, increasing the widths of the slots 15, while the portions of the necks 13 which are proximate to the widened slots diminish in thickness. Because the width of a neck 13 is substantially less than the maximum distance separating the outer edges of a link 12 (see FIG. 2), the ends of the strap 10 can be deflected as shown in FIG. 7 to a much greater extent without undergoing a permanent deformation than if the strap 10 did not have the slots 15. The curved outer side edges 18 thus enhance the capacity of the strap 10 to conform to the changing contour of an object across which the strap 10 is stretched.

By contrast, only a relatively small resistance is encountered when the strap 10 is bent across the curved surface of either a real or imaginary cylindrical object (see FIG. 5). The resistance to such bending is reduced by the inclusion of the slots 15 which decrease the width of the transverse sections of the strap at regular intervals along the centerline thereof.

The strap 10 may be formed in a single injection cycle. The strap is preferably formed by injection molding because it provides a strap of sufficient strength, requiring no reinforcing metal insert similar to that embedded in the thermoplastic belt described in the patent cited above. The random alignment of the long-chain polymers in the injection-molded strap 10 gives substantially more strength than does the generally parallel alignment of these polymers in a strip formed from a sheet of solid plastic.

The strap 10 is formed of a plastic such as polyethylene, polypropylene, polystyrene, vinyl, nylon, acrylonitrile-butadiene-styrene (ABS), or the like, or of rubber. In uses and applications in which a non-constrictive, but resilient strap which is sufficiently stiff to spread loads imposed upon it over a large area and which is at the same time comfortable to wear, the strap 10 is preferably formed of polyethylene or of polypropylene. Uses and applications for the strap 10 include securing protective devices such as knee braces about the legs of athletes participating in contact sports, affixing orthopedic braces and bandages, and reinforcing trouser waistbands, girdles, and harnesses.

The straps 10 formed of polyethylene or of polypropylene offer several advantages over bands formed of rubber or of rubber-like materials for the uses and applications described above. Firstly, the strap 10 so formed deforms less per unit load under the impact of a sudden force, allowing the impact to be dissipated over a larger area, but is sufficiently flexible to follow gradual fluctuations in the contour of the object across which the strap is extended. When used to secure a protective device about an athlete's leg, the strap 10 formed of polyethylene or of polypropylene both dissipates the force of an impact received by the device or strap and responds sufficiently quickly to the rolling and swelling of the athlete's leg during running that the wearer does not experience a feeling of constant binding or pressure from the strap.

Furthermore, in contrast to bands formed of rubber which tend to feel hot and heavy to a wearer, the straps 10, having short distances between the slots 15 and the apertures 14, feel lightweight and cool. In fact, the surface of the solid material in the strap 10 occupies an area which is only approximately one-half the area encompassed by a strap with straight side edges having the same overall width. This paucity of solid material per unit surface area in the straps 10 allows ample ventilation of a wearer's skin.

Moreover, in applications in which a strap is utilized to restrain a portion of a wearer's body mass as in the case of trouser waistbands for persons having large waistlines, bands formed of rubber tend to sag with the body mass they are intended to support. The straps 10 formed of polypropylene or of polyethylene, on the other hand, being sufficiently rigid for such an application, can support the wearer's abdomen without sagging.

An embodiment of the present invention which includes a buckle 20 is illustrated in FIGS. 8 through 13. As shown in FIG. 8, the buckle 20 and the flattened strip 11 described hereinabove comprise a single, unitary piece formed of a plastic such a polyethylene, polypropylene, polystyrene, vinyl, nylon, acrylonitrile-butadiene-styrene, or the like, or of rubber. The buckle 20 and the flattened strip 11 are preferably formed by injection molding in a single injection operation.

As illustrated in FIGS. 8 and 13, one end of the strip 11 is rigidly attached to the buckle 20. The truncated link 12*a* is connected to the sides of the protrusions 23*a* (FIG. 13). The opposite end of the strip 11 is held in position by the keeper 21 and a pin 26 formed on the buckle 20 (FIG. 8). A pair of protrusions 23 on the keeper 21 are engageable with a pair of slots 15 formed in the strip 11 (see FIGS. 8 and 11). The neck 13 disposed between a pair of slots 15 so engaged fits into the notch 22 formed between the protrusions 23, so that the link 12 which is in part disposed within the opening 27 is wedged between the protrusions 23 and the exposed face 24 of the buckle 20 when the strip 11 is secured thereto.

A pin 26 disposed on the exposed face 24 of the buckle 20 may be snapped into an aperture 14 formed in the next-to-the-last link 12 to have been fed through the keeper 21; the pin 26 comprises a means for maintaining the end of the strap 10 in position (see FIGS. 8 and 9). In addition, a ridge 25 may be formed in the exposed face as is best illustrated in FIGS. 9 and 10. The sharp edge 25*a* of the ridge 25 further restrains the strap 10, preventing it from slipping downwardly through the opening 27 when the strap 10 which is extended across a flexible object such as a wearer's leg muscle receives an impact near its connection with the buckle 20. Both the pin 26 and the ridge 25 are preferably slightly oversized for the apertures 14 and have notches 26*a* and 25*b*, respectively, formed therein into which the edges of a link 12 surrounding an aperture 14 may be fitted (FIG. 10).

Additionally, thickened corners 28 may be formed in the keeper 21, the thickness of the corners being somewhat greater than the width of the slots 15 in a direction parallel to the centerline of the strap 10. The thickened corners 28 are provided in order to prevent the keeper 21 from slipping into the slots 15 when a user is attempting to affix the strap 10 (FIGS. 8–10).

The similarity of both ends of the buckle 20 allows a user to sever the truncated link 12*a* from the protrusions 23*a* and then to attach both ends of a strip 11 to the buckle 20 by engaging a pair of protrusions formed on each respective end thereof with a pair of slots 15 formed in the strip.

It will be understood that various changes in the details, materials, and arrangement of parts, which have been herein described and illustrated in order to explain the nature of the invention, may be made by those skilled in the art within the principle and scope of the invention as expressed in the appended claims.

What is claimed is:

1. A strap which comprises:

at least one flattened strip formed of a resilient, non-metallic material, the strip having a plurality of uniformly spaced-apart, elongate, transversely extending apertures formed therein;

a plurality of pairs of slots, each slot extending from a side edge of the strip and having the respective end thereof terminating between and inwardly of the respective ends of a pair of the elongate apertures; and a plurality of arches, each arch being generally disposed between a side edge of the strip and the end of the aperture which is contiguous thereto; the width of each arch along a line which bisects the arch in a direction perpendicular to the centerline of the strip being greater than one half the width of each aperture along said centerline; the centers of curvature of the outer edge of each arch and of the end of said aperture being approximately coincident, thereby enhancing the spring action of the strip.

2. A strap according to claim 1 in which each aperture is further characterized as being greater in length than the combined width, measured in a direction perpendicular to the centerline of the strip, of a slot and of the solid material disposed between the respective ends of each pair of slots, so that an end portion of the strip may be inserted into an aperture formed in another portion thereof, thereby intertwining the strip with itself.

3. A strap according to claim 2 in which the strip further comprises:

a plurality of legs, each arch being connected to two legs, the legs on the same side of at least two pairs of slots formed in one portion of the strip being detachably engageable with the arches which are disposed proximate to the ends of a pair of apertures formed in a distal portion of the strip, so that the strip is intertwineable with itself to form a closed loop.

4. A strap according to claim 2 which further comprises:

at least one pair of flattened strips, each strip having a plurality of legs, each arch being connected to two legs, the legs on the same side of at least two pairs of slots formed in an end portion of a strip included in the pair of strips being detachably engageable with the arches which are disposed proximate to the ends of a pair of apertures formed in the other strip included in the pair of strips, all the flattened strips being connected together in pairs to comprise a strap of greater length than any one of the strips.

5. A strap according to claim 1 in which the flattened strip and the arches comprise a single, unitary piece formed of a thermoplastic selected from the group consisting of polyethylene and polypropylene, the unitary piece being further characterized as comprising randomly aligned, long-chain polymers of the thermoplastic, so that the strip has substantially greater mechanical strength than if it were formed from a single sheet of material.

6. A strap according to claim 1 which further comprises a buckle having a keeper with a pair of elongate, transversely extending protrusions which is engageable with a pair of slots formed in the flattened strip, the keeper having a notch on either side of which the protrusions are disposed, the span of the notch being substantially equal to the distance between a pair of diametrically opposed slots in the flattened strip, so that portions of the protrusions can be seated within said pair of slots at the same time the neck is seated within the notch.

7. A strap according to claim 8 wherein the buckle further includes a pin which extends therefrom in a direction away from said protrusions; the buckle, the keeper, and the pin comprising a single, unitary piece formed of plastic; the pin being engageable with an aperture in the strip when the protrusions are engaged with a pair of slots, so that a portion of the strip can be wedged between the keeper and the face of the buckle on which the pin is disposed.

8. A strap according to claim 1 in which each side edge of the strip along which the arches are disposed is further characterized as being formed generally in the shape of a continuous curve, thereby reducing the likelihood of a material failure due to excessive stress concentrations when a load is applied to the strip.

9. A strap according to claim 1 which further comprises a plurality of legs, each arch being connected to two legs; the width of each leg along a line parallel to the centerline of the strip being approximately equal to the width of each arch along a line, disposed perpendicularly to said centerline, which passes through the distal point on the arch, so that under tension the arch stretches generally uniformly, thereby allowing a load to be dissipated over a larger surface area of the strip than the immediate area of impact.

10. A strap according to claim 1 wherein each aperture is further characterized as being substantially equal in length to the combined width, measured in a direction perpendicular to the centerline of the strip, of a slot and of the solid material disposed between the respective ends of each pair of slots; the solid material increasing in thickness in response to a coı pressive load applied in a direction generally parallel to the centerline of the strip; the solid material and the arches comprising a single, unitary piece formed of plastic, so that the ends of a segment of the strip can be displaced along an arc in a direction away from the centerline of the unflexed strip when the strip is disposed with the transverse cross-sections of said segment being generally bisected lengthwise by the plane in which the arc lies, thereby providing a strip which can be flexed to adapt to a contoured surface with one side edge of the strip spanning a greater distance than the other.

* * * * *